US005875613A

United States Patent [19]

Maskell

[11] Patent Number: 5,875,613

[45] Date of Patent: Mar. 2, 1999

[54] METHOD AND DEVICE FOR EVACUATING GAS TIGHT ENVELOPE

[76] Inventor: Richard Maskell, 41W581 Old Stage Rd., Hampshire, Ill. 60140

[21] Appl. No.: 596,553

[22] Filed: Feb. 5, 1996

Related U.S. Application Data

[63] Continuation-in-part of Ser. No. 223,724, Apr. 6, 1994, Pat. No. 5,491,957.

[51] Int. Cl.[6] ..... B65B 31/00

[52] U.S. Cl. ..... 53/434

[58] Field of Search ..... 141/65; 53/432, 53/433, 434, 171, 510, 511, 512; 206/497; 426/396, 404, 410, 413

[56] References Cited

U.S. PATENT DOCUMENTS

| | | | |
|---|---|---|---|
| 3,185,371 | 5/1965 | Reifers | 206/497 X |
| 3,468,412 | 9/1969 | Forman | 206/497 |
| 3,696,580 | 10/1972 | Saltzer | 206/497 X |
| 4,188,769 | 2/1980 | Bright | 53/434 |
| 4,685,274 | 8/1987 | Garwood | 53/433 |
| 5,103,618 | 4/1992 | Garwood | 53/434 X |
| 5,109,654 | 5/1992 | Suga | 53/511 |
| 5,491,957 | 2/1996 | Maskell | 53/434 |

*Primary Examiner*—Daniel B. Moon
*Attorney, Agent, or Firm*—J. W. Gipple; Gipple & Hale

[57] ABSTRACT

An improved method and device are provided for evacuating gas from a gas tight envelope such as a bag of plastic film, enclosing one or more trays containing solid or granular material. The vacuum probe used in accordance with the invention to evacuate the envelope has one or more parallel grooves or apertures extending its length. The probe is inserted vertically into the envelope along the side of the tray and provides a vacuum, across the length of the probe to prevent blocking of the probe and ceasing evacuation of the gas.

5 Claims, 3 Drawing Sheets

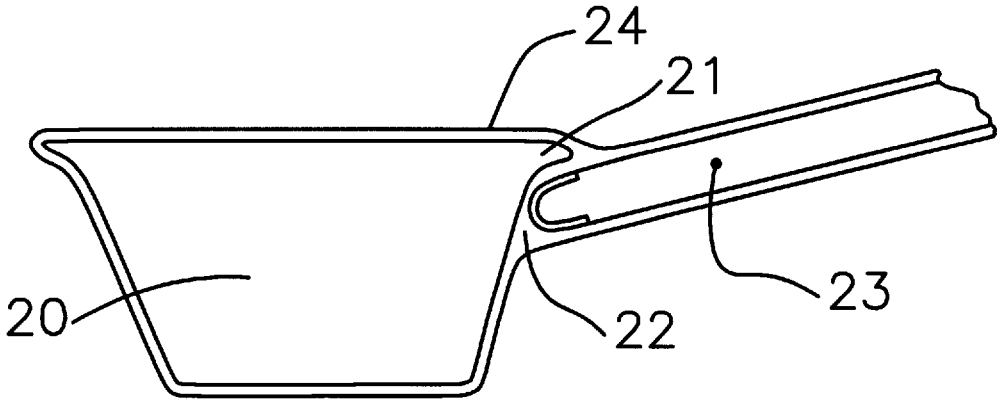
*FIG.* 7

METHOD AND DEVICE FOR EVACUATING GAS TIGHT ENVELOPE

CROSS-REFERENCE TO RELATED APPLICATION

This application is a continuation-in-part of application Ser. No. 08/223,724 filed Apr. 6, 1994 now U.S. Pat. No. 5,491,957.

SUMMARY OF THE INVENTION

The present invention is directed to an improved method and device for evacuating air from a gas tight envelope containing solid material in one or more trays. More specifically, the present invention is directed to an improved method for evacuating gas from solid material contained in one or more trays and enclosed by a flexible envelope such that the envelope more completely collapses owing to a more fully distributed vacuum.

BACKGROUND OF THE INVENTION

In the food packaging industry, it is a common practice to assemble a cluster of food products (e.g. meat or poultry) which have been individually packaged, and put the cluster into a larger plastic film bag or envelope, which is then evacuated, then reinflated and sealed. This maintains the fresh quality of the food products during storage and transportation.

The present invention is applicable to this type of master package, as well as to one containing individual unclustered items.

To accomplish evacuation of the gas from the plastic film envelope, a vacuum probe is inserted into the film envelope and the gas is sucked out. One problem encountered with this process, is that the tip of the probe where the vacuum orifices are disposed is pressed against the contents of the envelope and becomes blocked and ineffective. These orifices, which may be grooves extending only a short way from the probe tip, become clogged and ineffective by the collapsing plastic film envelope.

Additionally, in the conventional approach the vacuum is applied through the probe inserted into the contents of the envelope, requiring that the envelope have its opening on the top surface of a generally broad and shallow package. This creates an envelope geometry which consumes a relatively large amount of plastic film for the product size.

One variation on the conventional approach is to evacuate a side or end loaded envelope by using a vacuum probe which enters in a horizontal plane. This side-inserted probe encounters the same problem as one inserted from above. As the plastic film envelope collapses around the probe, the grooves or slots at the tip of the probe tend to become blocked by the content of the envelope.

Accordingly, it is an object of the present invention to provide an improved method of evacuating gas from a gas tight envelope containing solid material disposed in one or more trays without clogging or blocking the vacuum probe which is evacuating the gas.

It is a further object of the present invention to provide a a methodology, for evacuating gas from a gas tight envelope, which avoids potential clogging or blocking of the vacuum probe by the collapsing envelope.

BRIEF DESCRIPTION OF THE DRAWINGS

FIG. 7 illustrates an alternative, preferred embodiment of the method of the invention.

DETAILED DESCRIPTION OF THE INVENTION

In accordance with the present invention, a unique method is provided for evacuating gas from a gas tight envelope such as a plastic bag containing one or more objects that may be individual or clustered. According to the invention, the vacuum probe, which is a generally flat elongated structure having a plurality of apertures disposed on the surface of the probe, is inserted through the mouth of the envelope into the interior such that the face of the probe having the apertures or grooves is essentially opposed to the contents of the envelope rather than having only the tip of the probe directly opposing the contents. A vacuum is then applied to the probe to withdraw the gas from the envelope through the probe along its entire surface thereby avoiding blocking of the probe by either the solid material or the collapsing envelope. In this manner a complete evacuation of the envelope is accomplished with the flexible envelope collapsing tightly around the material contained therein. In the conventional approach, the vacuum probe is effective only at the tip and if that is clogged by the envelope or the contents of the envelope, evacuation of the gas ceases.

A further embodiment of the invention contemplates inserting the tip of a probe under or directly opposed to the lip of a tray containing one or more articles so that a vacuum is drawn through a continuous channel under the lip and not blocked by the collapsing envelope.

The invention in its various aspects will however be more fully appreciated by having reference to the drawings which illustrate preferred embodiments thereof.

Figure 2:
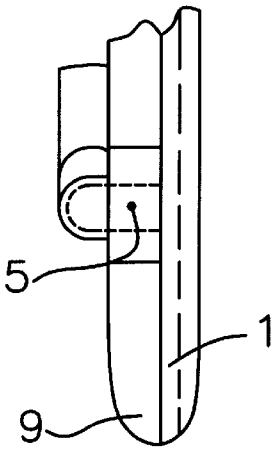
FIG. 2 illustrates the vacuum probe of FIG. 1 in its retracted position.
Figure 1:
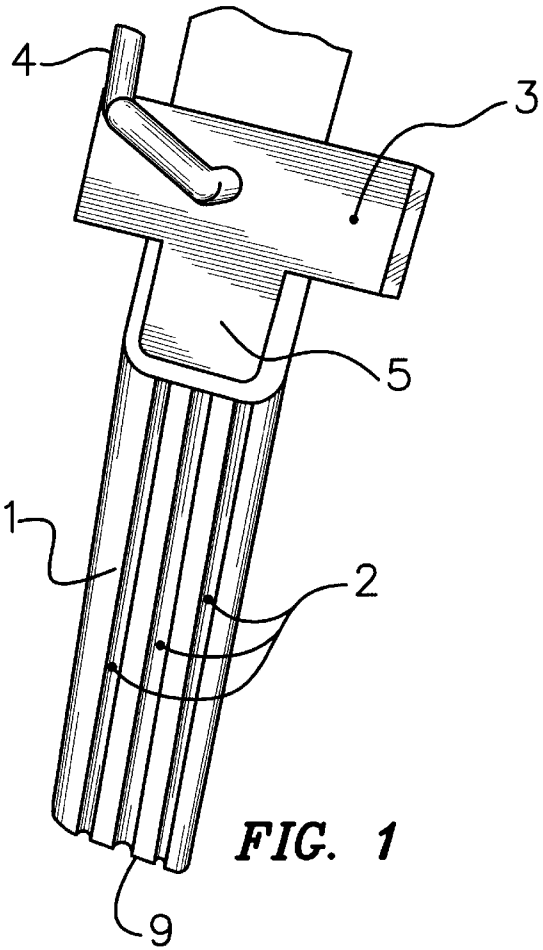
FIG. 1 is a perspective view of a vacuum probe and vacuum manifold plate typically employed in accordance with one aspect of the invention.

Directing attention to the drawings, FIGS. 1 and 2 illustrate the vacuum probe which can be employed in accordance with one aspect of the invention in both its extended and retracted positions. In FIG. 1 of the drawings, the vacuum probe 1, which is a generally flat elongated structure having a plurality of longitudinally disposed parallel grooves 2, is attached at one end to a manifold consisting of a vacuum cover plate 5 which communicates with a vacuum supply tube 4. The vacuum supply tube 4 is attached to a suitable source of negative pressure such as a vacuum pump which is not shown in the drawings. A manifold 3 in the vacuum cover plate distributes the vacuum to the grooves 2 of the vacuum probe 1. The face of the vacuum cover plate 5 is pressed or sealed against the vacuum probe by springs on each side of the cover plate which are not shown on the drawings.

Figure 3:
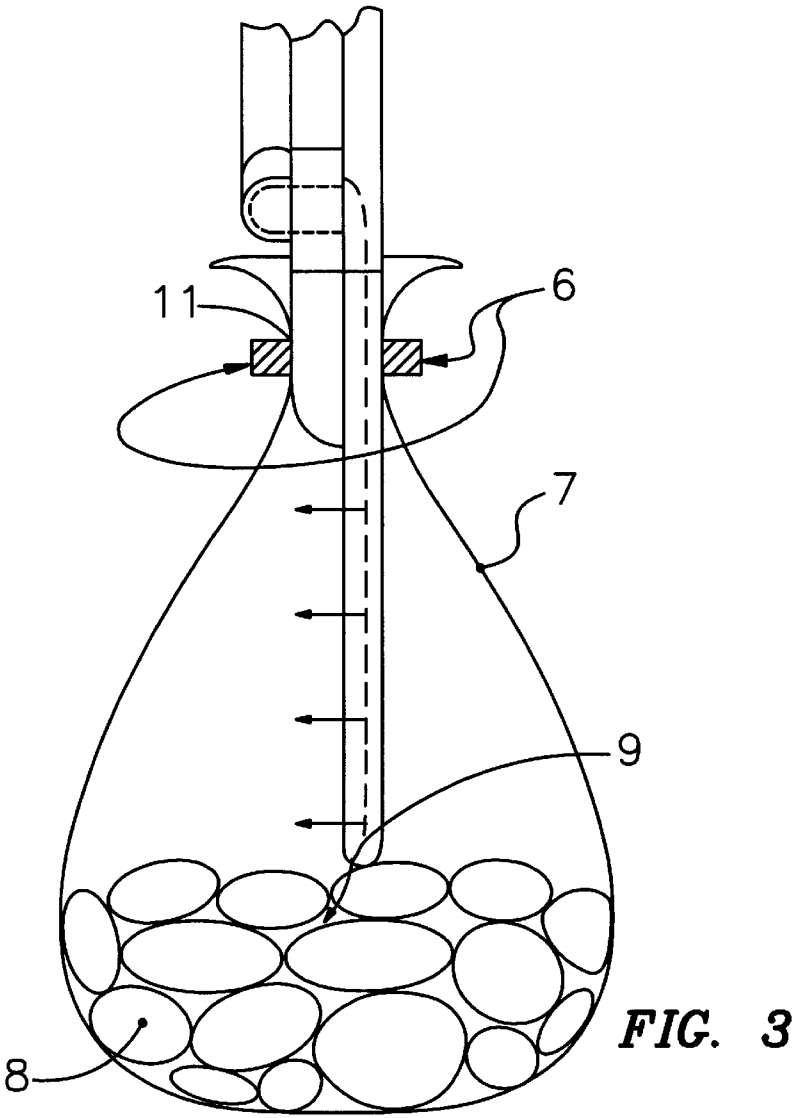
FIG. 3 illustrates a procedure of the prior art whereby the vacuum probe is inserted into the middle of a master package envelope containing clustered material.

In the retracted position illustrated in FIG. 2 of the drawings, the lower tip 9 of the probe is coincidental with the lower tip of the vacuum cover plate 5 to facilitate insertion into envelope 7, as illustrated in FIG. 3 of the drawings, during the envelope loading process.

Figure 4:
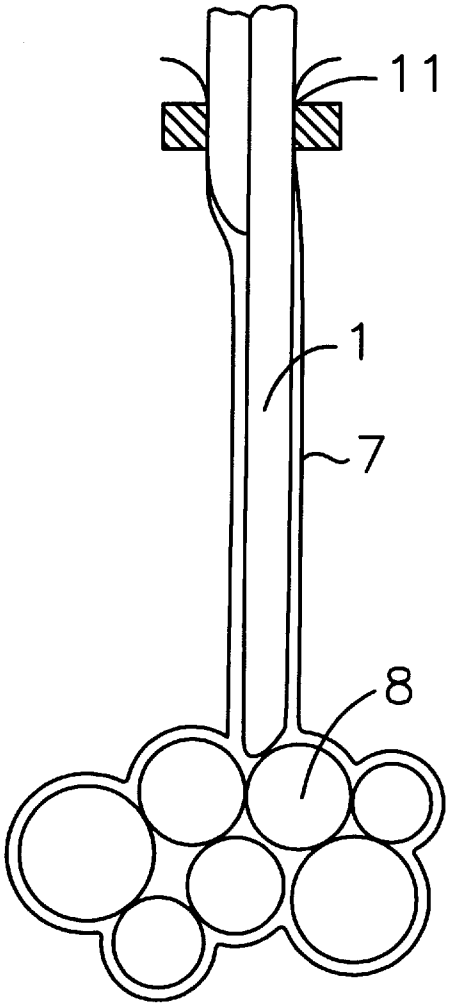
FIG. 4 illustrates the prior art procedure of FIG. 3 whereby the envelope has collapsed around the vacuum probe and the clustered material in the envelope.

Turning to FIGS. 3 and 4 of the drawings, once the envelope is pulled up around the probe and its cover plate, the jaws 6 are clamped over the assembly to provide an air tight seal. The jaw clamps the bag 7 shut across the width of the envelope mouth 11 and rubber seals close the envelope around the probe and cover plate. The retracted probe 1 is then extended into the envelope 7 and vacuum applied through the vacuum supply tube and manifold across the face of the probe into the envelope. When the envelope head space is still incompletely evacuated, vacuum is available to the interior of the envelope through the grooves across the entire front face of the probe. Once the envelope collapses tightly against the grooves, the grooves become in effect tubes with the plastic envelope acting as a fourth side of each tube as illustrated in FIG. 4 of the drawings.

In conventional practice, as shown in FIGS. 3 and 4 of the drawings, the product 8 typically is a solid or granular material which is positioned at the bottom of the envelope 7 below the tip 9 of the extended probe 1. After the envelope collapses on the probe as shown in FIG. 4 of the drawings, vacuum is conveyed to the product only at the tip of the probe 9 as also shown in FIG. 4 of the drawings. And if the tip is blocked by the content of the envelope, evacuation of the gas from the envelope ceases.

Figure 6:
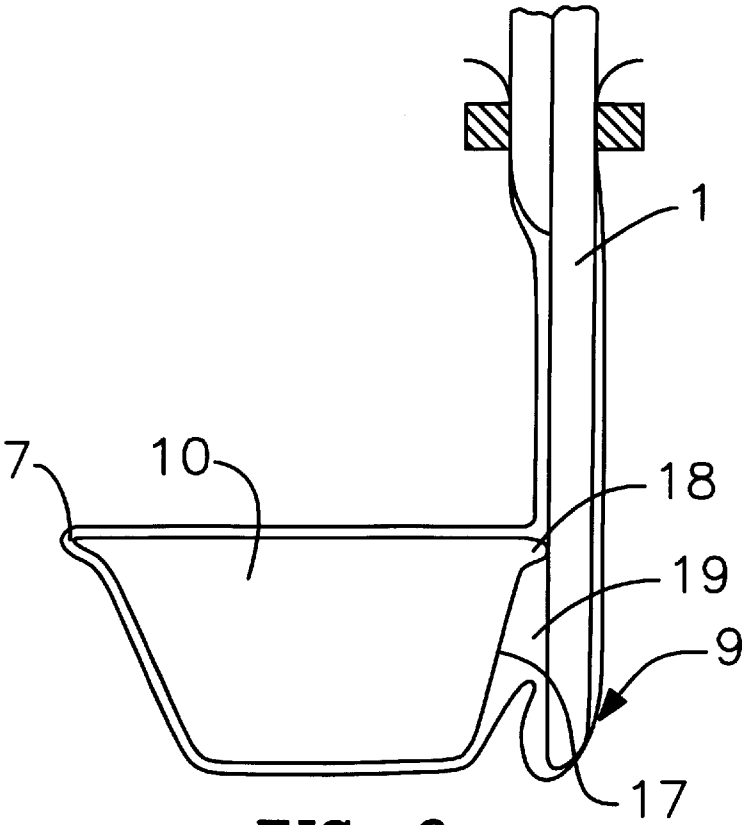
FIG. 6 illustrates one procedure of the present invention whereby the vacuum is applied across the entire surface of the vertical probe tangentially to one or more trays in a master package.
Figure 5:
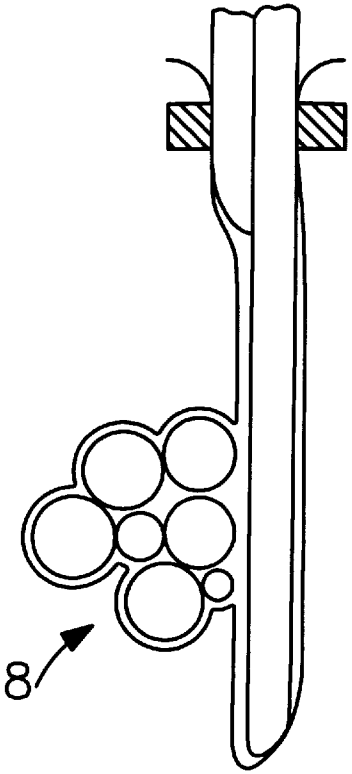
FIG. 5 illustrates one procedure of the present invention whereby the vacuum is applied across the entire surface of the probe tangentially opposing the product.

In contrast to the practice of the prior art, as illustrated in FIGS. 3 and 4 of the drawings, the method of the present invention as shown in FIGS. 5 and 6 of the drawings, uses a probe which passes downward alongside and opposite the product 8 so that the vacuum applied to the vacuum probe is transmitted to the product 8 from the front face of the probe rather than from just the lower tip as shown in FIG. 4 of the drawings, even after the bag has collapsed around the probe as shown in FIG. 4 and 5 of the drawings.

One preferred embodiment of the present invention is illustrated in FIG. 6 of the drawings in which one of a plurality of trays 10 are shown within envelope 7. Tray 10 has sidewalls 17 which terminate in a lip 18 which overhangs the sidewalls. Thus, when a vacuum is applied to extended probe 1 which is disposed alongside sidewall 17, envelope 7 collapses around the tray 10. The overhanging lip 18, however, creates a vacuum gallery on the face of the tray which contacts the probe and also provides a connected series of such galleries between the lips of adjacent trays similarly disposed within the envelope. Thus, the vacuum passing from the probe is immediately transmitted throughout the connected galleries all the way to the far end of the envelope most remote from the probe irrespective of the number of trays arranged within the envelope. The open gallery or passage which is thereby created under the lip of the tray prevents obstruction of the vacuum probe since the envelope does not completely collapse enough to block this passage.

FIG. 7 illustrates a most preferred embodiment of the invention in which the vacuum probe 23 is inserted at an angle under the lip 21 of container 20 so that a continuous channel 22 is formed which is not blocked by collapsed envelope 24. It will be understood that in this embodiment, the probe 23 is required to have orifices only at the tip.

The probe is inserted more or less horizontally to the plane of the container. Illustrated in FIG. 9 is the probe 23 at an angle of about 30° above horizontal, but it could be at an angle below horizontal. Any position that puts the tip of the probe into the channel 22 will function according to this invention.

The present invention is particularly useful and significant where the contents of the envelope create a broad but shallow shape. The use of a vacuum probe in conventional manner requires an envelope which has its opening on the top surface of a broad shallow shaped package which creates an envelope geometry consuming a relatively large amount of bag film material for the product size. On the other hand, if a side loaded or end loaded envelope is used for a package having this shape, very substantial savings are available as the envelope may be as much as 30% smaller in overall size.

In accordance with prior art procedures, the conventional approach for a side or end loaded envelope (not illustrated in the drawings), has been to use a hollow or tubular probe entering the envelope in a horizontal plane. This procedure encounters the same problem as the probe entering on a vertical plane in that the vacuum is vulnerable to being blocked by either the envelope's plastic film material or the content of the envelope. In accordance with the present invention blockage of the vacuum probe is avoided and the vacuum can continue to be exerted around the content to remove gas or air from voids that would otherwise remain.

Thus, in accordance with the present invention the vacuum probe is inserted into an envelope containing solid or granular material, with the probe exerting a vacuum against both the material and the collapsing envelope until it is essentially completely evacuated without becoming clogged or blocked by either the envelope or its content.

What is claimed is:

1. A method for evacuating gas from a gas tight envelope containing solid or particulate material disposed in a tray having sidewalls with overhanging lip, comprising inserting through an opening in said envelope to a position under said lip, an elongated vacuum probe extending from a vacuum source, applying a vacuum to said probe to withdraw gas from said envelope and collapsing said envelope around said tray containing said solid material.

2. The method of claim 1 wherein said lip which overhangs a portion of said sidewalls forms a channel for said gas when said envelope collapses.

3. The method of claim 1 wherein said probe is inserted into said gas tight envelope which contains a plurality of trays having sidewalls and an overhanging lip and contains solid or particulate material and said vacuum is applied to said probe under one of said lips to withdraw gas from the envelope and collapse it around said trays.

4. The method of claim 3 wherein said trays each have a lip which overhangs a portion of its respective sidewall to form a channel for said gas when said envelope collapses.

5. The method of claim 4 wherein the respective channels of each tray interconnect to form a continuous passage for said gas.

* * * * *